US010144191B2

(12) United States Patent
Menegazzi

(10) Patent No.: US 10,144,191 B2
(45) Date of Patent: Dec. 4, 2018

(54) METHOD AND DEVICE FOR FITTING REINFORCEMENTS ON A CARDBOARD PACKAGING CUTOUT, AND CORRESPONDING PACKAGING

(71) Applicant: OTOR, Puteaux (FR)

(72) Inventor: Franck Menegazzi, Dijon (FR)

(73) Assignee: OTOR, Puteaux (FR)

( * ) Notice: Subject to any disclaimer, the term of this patent is extended or adjusted under 35 U.S.C. 154(b) by 0 days.

(21) Appl. No.: 14/911,987

(22) PCT Filed: Aug. 14, 2014

(86) PCT No.: PCT/FR2014/052091
§ 371 (c)(1),
(2) Date: Feb. 12, 2016

(87) PCT Pub. No.: WO2015/022472
PCT Pub. Date: Feb. 19, 2015

(65) Prior Publication Data

US 2016/0193801 A1 Jul. 7, 2016

(30) Foreign Application Priority Data

Aug. 14, 2013 (FR) ..... 13 58014

(51) Int. Cl.
*B31D 5/00* (2017.01)
*B65D 5/44* (2006.01)
(Continued)

(52) U.S. Cl.
CPC ..... *B31D 5/0004* (2013.01); *B31D 5/0026* (2013.01); *B65D 5/445* (2013.01);
(Continued)

(58) Field of Classification Search
CPC ... B31D 5/0004; B31B 7/00; B31B 2217/106; B31B 2241/001; B31B 2217/0038; B65D 5/445
(Continued)

(56) References Cited

U.S. PATENT DOCUMENTS 5,897,481 A * 4/1999 Baumuller ..... B31F 1/0077 101/22
2006/0124712 A1 6/2006 Weimer, Jr.
2012/0325830 A1 12/2012 Chapman et al.

FOREIGN PATENT DOCUMENTS

GB 2472257 A 2/2011
WO 03/099667 A1 12/2003
(Continued)

OTHER PUBLICATIONS

International Search Report dated Nov. 11, 2014, issued in corresponding International Application No. PCT/FR2014/052091, filed Aug. 14, 2014, 3 pages.
(Continued)

*Primary Examiner* — Christopher Demeree
(74) *Attorney, Agent, or Firm* — Christensen O'Connor Johnson Kindness PLLC

(57) ABSTRACT

The invention relates to a method, a device and packaging obtained by way of the method, for fitting at least one reinforcement at a given location on a cutout of cardboard sheet or corrugated cardboard suitable for forming the packaging. The blank is removed from a store with the aid of unstacking means comprising a longitudinal structure with a given shape, the blank is transferred horizontally above a template for forming said blank, the blank is compressed between the template and said longitudinal structure, the blank thus configured is transferred with glue being applied to the side edges and the blank thus glued is
(Continued)

applied to the cutout at the given location so as to form the reinforcement of said packaging.

16 Claims, 10 Drawing Sheets

(51) Int. Cl.

| | |
|---|---|
| ***B31B 7/00*** | (2006.01) |
| *B31B 50/28* | (2017.01) |
| *B31B 50/44* | (2017.01) |
| *B31B 50/81* | (2017.01) |
| *B31B 120/40* | (2017.01) |
| *B31B 105/00* | (2017.01) |
| *B31B 120/00* | (2017.01) |

(52) U.S. Cl.
CPC ..... *B31B 50/28* (2017.08); *B31B 50/44* (2017.08); *B31B 50/81* (2017.08); *B31B 2105/00* (2017.08); *B31B 2120/40* (2017.08); *B31B 2120/502* (2017.08); *B31B 2241/001* (2013.01)

(58) Field of Classification Search
USPC ..... 229/199; 493/379, 51, 58, 93, 94, 95, 493/97, 98, 101, 71, 72, 123, 124, 125; 414/797
See application file for complete search history.

(56) References Cited

FOREIGN PATENT DOCUMENTS

WO 2008/042176 A2 4/2008
WO WO 2011124782 A1 * 10/2011 ..... B65H 3/0816

OTHER PUBLICATIONS

Written Opinion of the International Searching Authority, issued in corresponding International Application No. PCT/FR2014/052091, filed Aug. 14, 2014, 5 pages.
Written Opinion of the International Searching Authority dated Nov. 18, 2014, issued in corresponding International Application No. PCT/FR2014/052091, filed Aug. 14, 2014, 5 pages.
International Preliminary Report on Patentability dated Feb. 16, 2016, issued in corresponding International Application No. PCT/FR2014/052091, filed Aug. 14, 2014, 1 page.

* cited by examiner

METHOD AND DEVICE FOR FITTING REINFORCEMENTS ON A CARDBOARD PACKAGING CUTOUT, AND CORRESPONDING PACKAGING

The present invention relates to a method for fitting at least one reinforcement obtained from a cardboard or corrugated cardboard blank, in a given location of a cardboard or corrugated cardboard sheet cutout which can form packaging.

It also relates to a device for fitting a reinforcement of this type and corresponding packaging, obtained in particular by using a device of this type.

It has a particularly important, although not exclusive, application in the field of reinforced packaging for heavy products such as bottles and/or packaging which requires vertical packaging walls which are particularly resistant to compression, whilst permitting lateral access for the products.

By means of the invention it will in fact be possible for example to obtain packaging which is perforated on one or two opposite sides, whilst comprising two particularly strong bearing walls. It also makes it possible to obtain compact trays which can be stacked up to large heights.

Cardboard boxes are already known (U.S. Pat. No. 5,950,911) provided with walls which are reinforced vertically by folds which form reinforcements.

Although packaging of this type indeed has improved resistance to compression, it is not easy to mechanize, and requires a base which forms a tray in which the walls which form the reinforcement folds are embedded in a fitted manner.

Reinforced trays are also known with corners provided with turned-down pieces which are attached to the walls and folded back towards the interior of the tray in order to form angle struts.

Trays of this type are used in particular to store fruit and vegetables, and are complicated to form rapidly and automatically.

In general, although there exist many types of packaging with or without added reinforcements, there is no efficient, rapid and automatic method for fitting vertical reinforcements with reduced dimensions which are easy to implement, and can be placed in any location on the walls of packaging, but preferably in a centered manner.

The objective of the present invention is to provide a method and a device for fitting a reinforcement/reinforcements in packaging which eliminate these disadvantages, and comply better than the types of packaging previously known with the requirements in practice, particularly in that the invention enables the formation of asymmetrical packaging, in that it permits forming and fitting of reinforcements which have along their entire length (height of the packaging) an angle at the top and/or a recess which is central relative to the wall of the packaging, thus making it possible to form a hollow strut, thereby permitting great resistance to compression, and in that the reinforcements are formed automatically and at a fast pace, i.e. more than 30 strokes/minute, for example 40 or 50 strokes/minute.

For this purpose, the invention proposes in particular a method for fitting at least one reinforcement in a given location of a cardboard or corrugated cardboard sheet cutout, which can form packaging provided with walls with a given height, the reinforcement being obtained from a cardboard or corrugated cardboard blank with a length equal to said given height, characterized in that:

the blank is extracted from a store by grasping it by aspiration using unstacking means comprising a longitudinal structure with a given form, designed to be placed above the blank thus grasped in the direction of the length of the blank;

the blank is transferred horizontally above a template for forming of said blank with a form which is at least partly complementary to said given form;

the blank is compressed between the template and said longitudinal structure, in order to provide part of the blank with said given form, and form horizontal longitudinal lateral edges;

the blank thus configured is transferred and the lateral edges are glued; and the blank thus glued is applied on the cutout in the given location, in order to form the reinforcement of said packaging.

Since the reinforcement has a length equal to (equal means strictly equal to, or slightly more than, for example 1 to 2 mm more than, in order to allow the reinforcement to play its part) the length of the reinforced flap which is designed to form a wall of the packaging. This allows the reinforcement to play a support part on the height of the wall, once the reinforcement has been glued in the given location, when the packaging is formed, and the base and/or the lid are folded by 90°. This given location is in fact designed to permit coincidence of the lower and upper edges of the reinforcement with the folding and/or end edge lines of the flap on which it is glued.

According to the embodiment of the invention which is more particularly envisaged, the given form of the longitudinal structure has a transverse cross-section in the form of an inverted "V" or "U", which will allow the reinforcement to have an equivalent transverse cross-section.

In advantageous embodiments, in addition and/or moreover there is recourse to one and/or the other of the following arrangements:

- two reinforcements are formed and fitted simultaneously on two opposite walls of the cutout which can form the packaging;
- the reinforcement blanks are transferred from two different stores situated in the vicinity of one another;
- the reinforcement blanks are transferred from two different stores situated on both sides of the cutout;
- the reinforcement blanks are obtained from a single store of blanks with a divisible base, which bases are separated into two before transfer above their respective template;
- with the cutout being formed by a series of at least four flaps ending on one side in a series of turned-down pieces, said cutout is placed flat, and said reinforcements are applied horizontally on said cutout;
- with the cutout preformed as a box which is open at the top, and having at least four vertical walls, the reinforcements are tilted vertically, then introduced into the packaging before being applied laterally on two opposite vertical walls of the packaging.

Advantageously, the packaging is obtained by wrapping around a mandrel.

When the reinforcements are placed on the flat cutout, the mandrel is then provided with perforated walls which make it possible to avoid the reinforcements during the forming, and/or the mandrel is formed by corner angles which are held to one another by braces, the distance of which is optionally adjustable, in order to vary the size of the mandrel.

The invention also proposes a device which implements the above-described method.

It also relates to a device for fitting at least one reinforcement in a given location of a cardboard or corrugated cardboard sheet cutout which can form packaging provided with walls with a given height, the reinforcement being obtained from a cardboard or corrugated cardboard blank with a length equal to said given height, characterized in that it comprises:

means for gripping the blank in a store by aspiration, comprising unstacking means comprising a longitudinal structure with a given form, designed to be placed above the blank thus grasped;

a template for forming said blank with a form which is at least partly complementary to said given form; means for transfer of the blank horizontally above said forming template, fitting of the blank by compression between the template and said longitudinal structure in order to provide it partly with said given form, and to have horizontal longitudinal lateral edges, and transfer of the blank thus configured opposite the cutout in the given location;

means for gluing the lateral edges and pressing the blank thus glued on said cutout in order to form the reinforcement of said packaging.

In an advantageous mode of the invention, the transverse cross-section of the given form is in the form of an inverted "V" or "U".

Advantageously, the device comprises two different stores situated in the vicinity of one another.

According to another advantageous embodiment, it comprises two different stores situated on both sides of the cutout.

Also advantageously, it comprises a single store with divisible blanks, and means for separation into two of the divisible blanks before transfer above their respective template.

Advantageously, with the cutout being formed by a series of at least four flaps which end on one side in a series of turned-down pieces, the device comprises means for bringing the cutout flat, and for application of said reinforcements horizontally on the cutout.

According to an advantageous embodiment, the device additionally comprises a mandrel provided with walls which are perforated and/or formed by corner angles which make it possible to avoid the reinforcements during the subsequent forming of the packaging around the mandrel.

According to another embodiment, with the cutout preformed as a box open at the top, and having at least four vertical walls, the device comprises means for vertical tilting of the reinforcements, introduction into the packaging, and application laterally on two opposite vertical walls of the packaging.

Advantageously, the preformed cutout is obtained by wrapping around a mandrel.

The invention also relates to packaging made of cardboard or corrugated cardboard sheet material in the form of a box with a polygonal cross-section comprising lateral walls with a given height and a lower wall which forms the base of the box, characterized in that it comprises at least one reinforcement obtained from a cardboard or corrugated cardboard blank with a length equal to, or substantially equal to, said given height, said reinforcement being arranged in the direction of the height of the box, on an inner face of the packaging, and having a central part with a transverse cross-section in the form of an inverted "V" or "U", and two longitudinal lateral edges glued on said inner face, which edges are situated entirely spaced from the junctions with the adjacent lateral walls.

Substantially equal to means equal to the production tolerances of the finished cardboard, for example slightly more than 1 to 2 mm, in order to make possible good distribution of the loads.

Advantageously, the packaging has two reinforcements situated opposite one another and in a centered manner, on two opposite faces.

Also advantageously, the packaging is formed according to the method as previously described.

Also advantageously, the packaging has eight sides, i.e. four main walls which are separated by four intermediate walls forming cut corners.

The invention will be better understood by reading the following description of particular embodiments provided hereinafter by way of non-limiting example.

The description relates to the accompanying drawings, in which.

FIGS. 9 and 10, and 11 and 12 are views in perspective, respectively of blanks with reinforcements and boxes or trays obtained by means of blanks of this type, according to other embodiments of the invention.

FIGS. 13 to 18 are partial views in perspective showing a device according to another embodiment of the invention, making it possible to obtain reinforcements from two separate stores of blanks.

Figure 19:
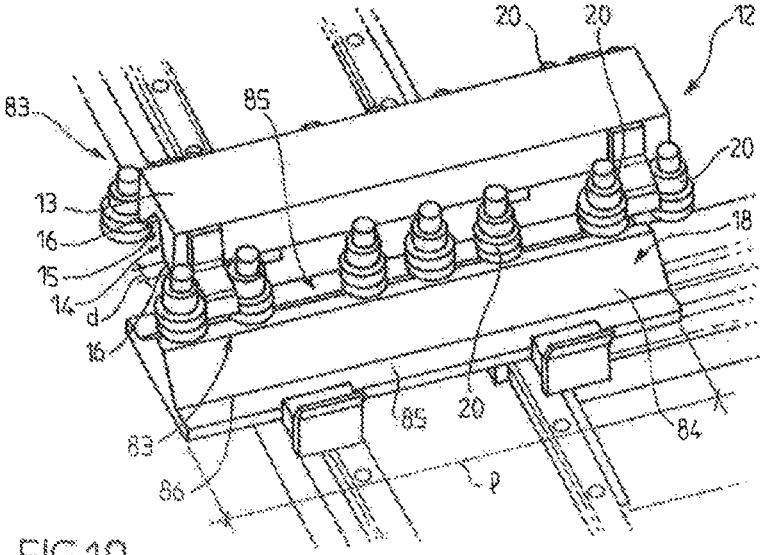
Figure 20:
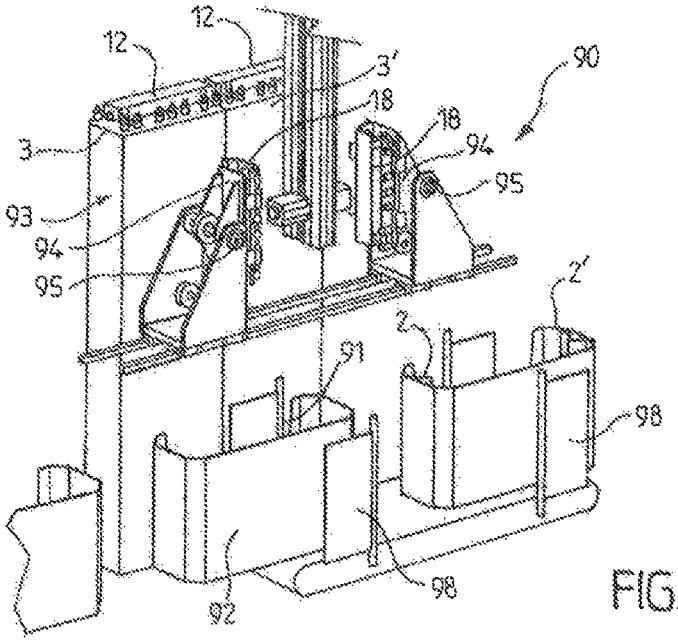
Figure 21:
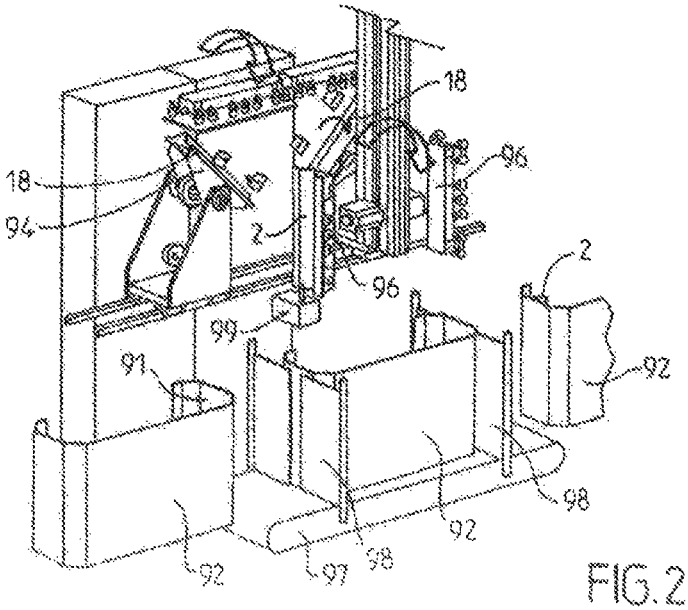

FIG. 19 is an enlarged view of the unit for gripping and forming the reinforcement according to the embodiment of the invention more particularly described here.

FIGS. 20 to 23 show in perspective and partially another embodiment of a device according to the invention, with tilting of the reinforcements and gluing inside preformed packaging.

Hereinafter in the description, the same reference numbers will be used to designate the same elements or similar elements.

Figure 1:
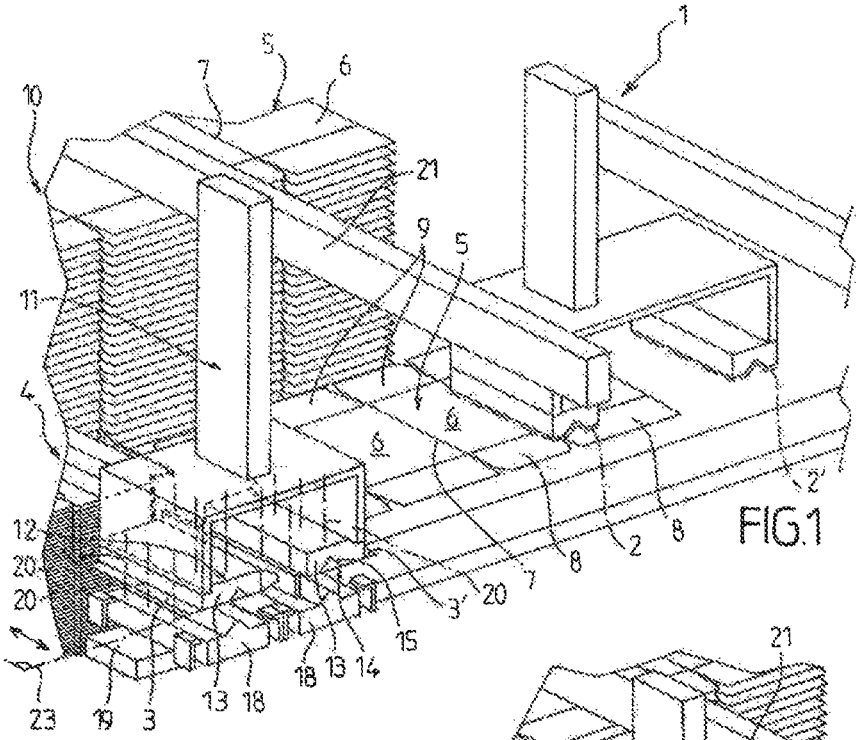
FIG. 1 is a partial view in perspective of the fitting device according to an embodiment of the invention, at the forming of the reinforcements from a single store for supply of blanks.

FIG. 1 shows (partially) a device 1 for forming two reinforcements 2, 2' obtained from rectangular blanks 3, 3' with a given length made of corrugated cardboard (which is for example 3 to 5 mm thick) stored in a vertical store 4 for fitting onto cutouts 5, which are formed for example by a series of rectangular flaps 6, for example four flaps which are connected to one another by folding lines 7 and end at each side in turned-down pieces 8, 9 in a manner which in itself is known.

The cutouts 5 are for example also stored in a vertical store 10, and brought into position one by one, for example by tilting aspiration means which in themselves are known (not represented), each cutout 5 then being displaced, for example by means of a conveyor belt (also not represented here), in order to be reinforced by said reinforcements obtained after forming.

More specifically, the blanks 3, 3' are grasped by aspiration by means of the unstacking means 11 comprising two gripping systems 12 with suckers each provided with a longitudinal structure 13 with a lower face 14 with a central groove 15 which has a length equal to, or substantially equal to, that of the blanks grasped, and a transverse cross-section in the form of an inverted "V". The lower face 14 also comprises two horizontal longitudinal strips 16, 17 on both sides of, and in the continuity of, the tops of the groove in the form of a "V".

The device also comprises two templates 18 each with an upper face 19 with a form complementary to that of the lower face 14 of the longitudinal structure 13.

The system 12 comprises suckers 20 (schematized by broken lines in FIGS. 1 and 2) for gripping the blanks, and transferring them between the vertical storage store 4 and the position opposite the templates 18, in this case therefore two parallel templates for two opposite systems 12, for example by means of a displacement bridge 21 which in itself is known.

Figure 2:
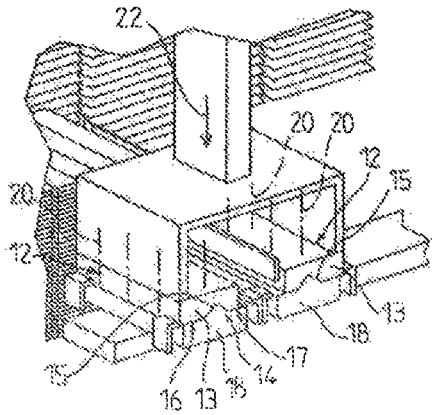
FIG. 2 shows the (partial) device in FIG. 1 during the compression of the blanks between the longitudinal structures and the templates.
Figure 3:
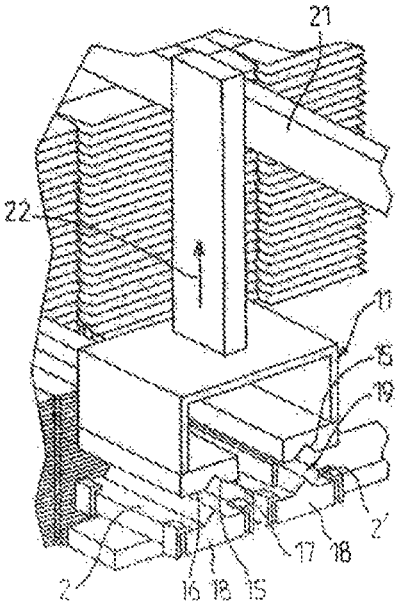
FIG. 3 shows the start of the transfer of the blanks after the forming represented in FIG. 2.
Figure 1A:
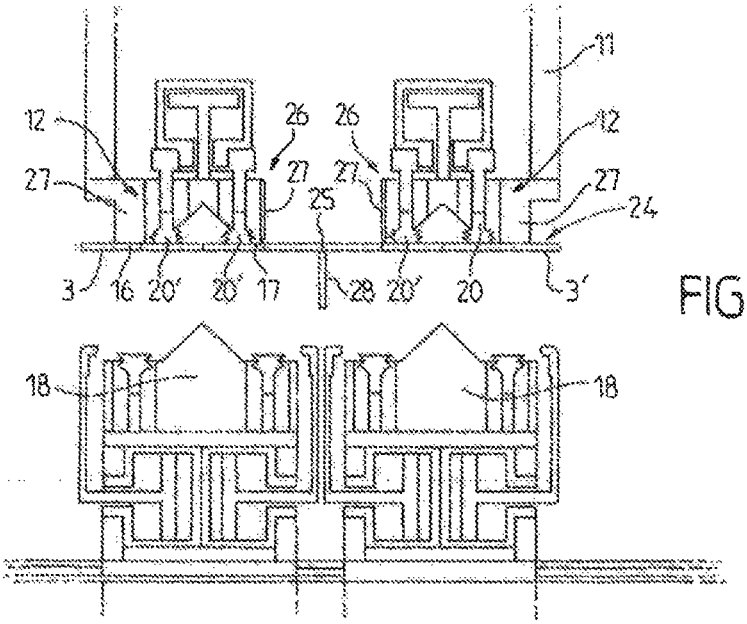
FIGS. 1A and 1B show in cross-section the initial steps of separation of a base blank into two blanks, in order to obtain reinforcements according to the embodiment in FIG. 1.
Figure 1B:
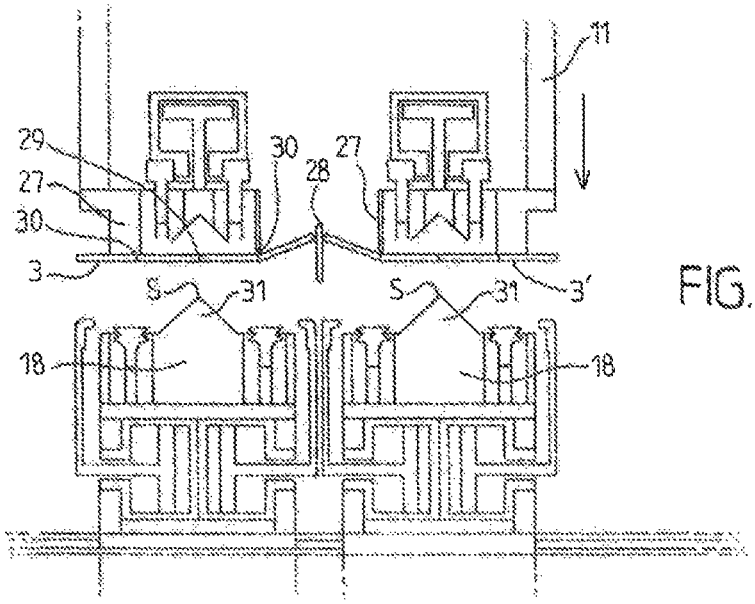

The device additionally comprises means for pressing or compression (arrow 22) of the blanks 3, 3' on the template, for example comprising a piston with vertical actuation between the transfer position (plane 23 shown as a broken line in FIG. 1) and the pressing position (FIG. 2).

Once the blanks have been compressed in the structure in the form of an inverted "V", the systems 12 for gripping by means of a sucker 20 are raised vertically, then displaced in order to take the following blanks from the stack 4, and so on.

The steps are shown of forming reinforcements obtained simultaneously from a base blank in FIGS. 1A, 1B and 2A, 2B.

In this embodiment, a base blank 24 is formed from the two blanks 3 and 3' which are connected to one another by a cutting line 25 and grasped by the suckers 20 of the system or gripping means 12.

The suckers 20 are placed under vacuum by means of circuits 26 which are controlled automatically in a known manner.

The systems 12 are included in, and/or are integral with the unstacking means 11, and each comprise a longitudinal structure 13 provided with its central groove 15 and its longitudinal strips or portion of strip 16, 17, or any other configuration which forms lateral horizontal stops 27 in contact with the ends of the blanks 3, 3'.

During the descent of the gripping means towards the templates 18, the cutting line 25 abuts a blade 28 for separation of the blanks 3 and 3', the vacuum of the suckers being relaxed.

Figure 2A:
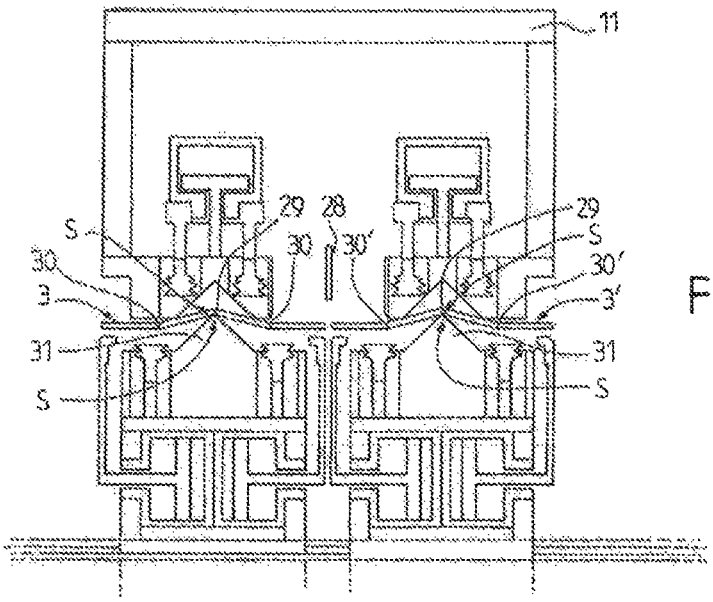
FIGS. 2A and 2B are views in cross-section of the descent of the blanks onto the templates.
Figure 2B:
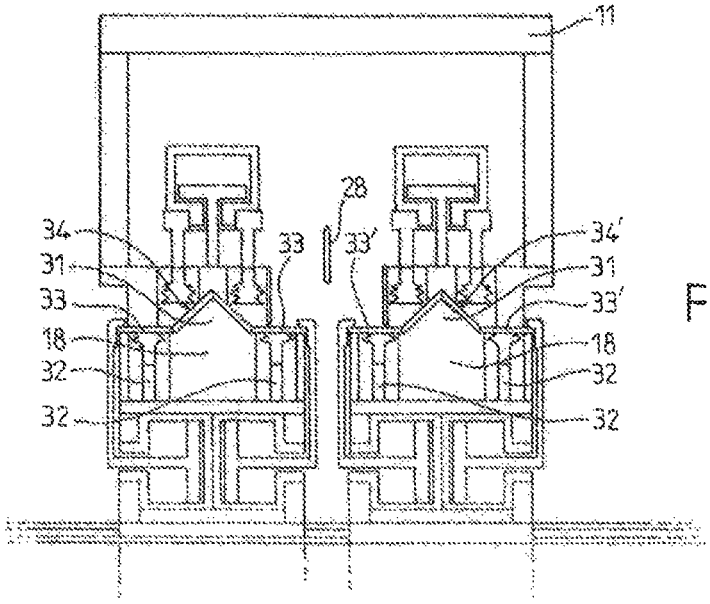

FIGS. 2A and 2B represent the continuation of the descent of the stops 27, which thrust the blanks 3 and 3' respectively, in order to bring a central folding line 29, 29' of the blanks 3 and 3' (which also each comprise two parallel lines 30, 30' which are on both sides of, and symmetrical relative to the central line 29, 29') into contact with the top S of the complementary form of the "V" 31 of the template 18.

Abutment means 32 situated below the longitudinal lateral edges 33, 33' of the blanks make it possible to obtain formed reinforcements provided with a central part 34, 34' in the form of a "V", and with the two horizontal longitudinal lateral edges 33, 33'.

Figure 4:
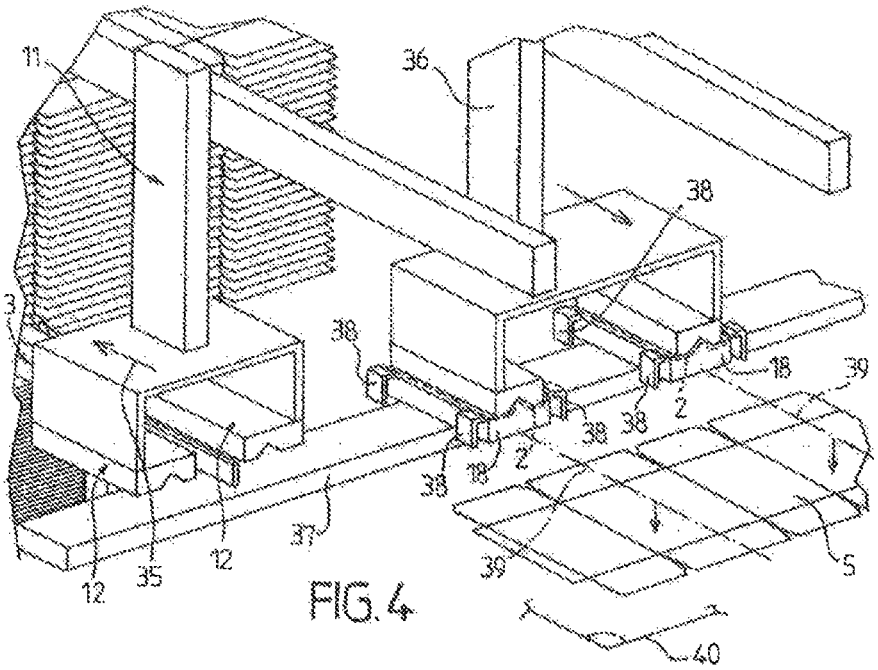
FIGS. 4 and 5 show the device in FIG. 1 during the continuation of the transfer of the blanks, in order to put them into position (FIG. 4) then to apply them on the cutout once they have been glued (FIG. 5).

At the end of pressing of the reinforcements (cf. FIG. 4), the unstacking means 11 and the means or systems 12 for gripping by means of suckers are brought to the store 4 of base blanks (arrow 35) and a system (for example a bridge) for transverse displacement of the templates 18 provided with the reinforcements 2, 2' recuperates the latter, which can also be displaced laterally on a path 37 via bearings 38 integral with the templates, by spacing them in order to arrange said templates at the level of the given locations (broken lines 39) of the cutout 5, which moreover is conveyed in a manner which in itself is known, for example by a conveyor belt with a blocking catch, into the position (plane 40) of putting the reinforcements 2, 2' into place.

Figure 5:
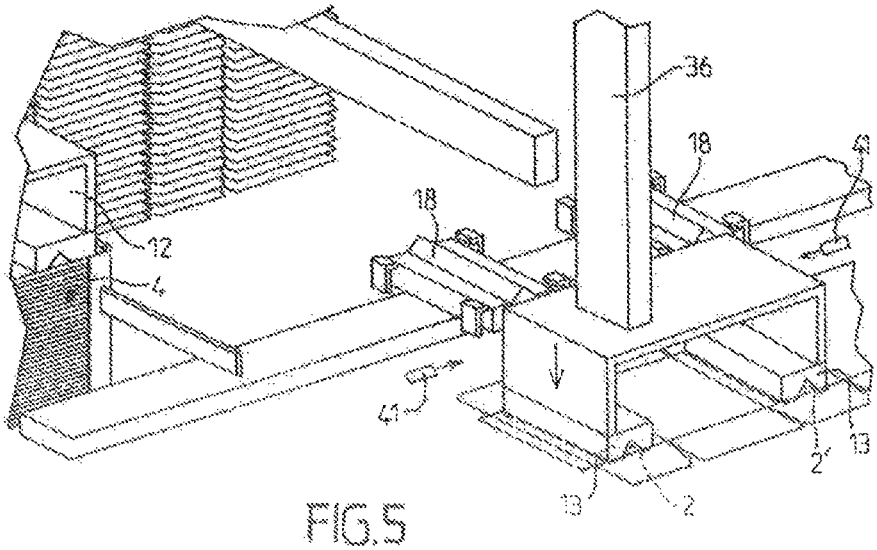

With reference to FIG. 5, the reinforcements 2, 2' are then grasped by suckers with means similar to those described with reference to the unstacking means, and are displaced, in order to be placed, after gluing of the lateral edges on the path at 41, on said given locations of the cutout, in a precise manner, thanks to programming and control means of the system 36, which in themselves are known.

Figure 6:
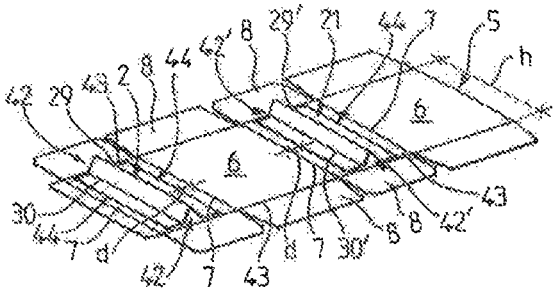
FIG. 6 is a view in perspective of a cutout, making it possible to obtain packaging according to an embodiment of the invention, with two reinforcements.
Figure 7:
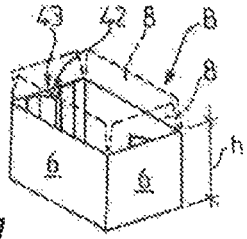
FIG. 7 is a view in perspective of the box formed from the blank in FIG. 6.

FIGS. 6 and 7 represent the cutout 5 with reinforcements 2, 2' obtained with the devices in FIGS. 1 to 5, as well as the box B obtained by means of a cutout of this type.

In this case, the cutout comprises a series of four rectangular flaps 6 made of corrugated cardboard separated by folding lines 7, and which cutout is provided at its end with a gluing tab in a manner which in itself is known.

Each flap has a given length h (or height of the wall of the box).

Two series of rectangular turned-down pieces 8 are arranged on both sides in order to form respectively the top and the bottom of the box.

Each reinforcement 2, 2' formed by a strip of cardboard or obtained from the blanks 3, 3' is arranged in the direction of the length of the corresponding flap 6, and has a length equal to that of the flap, such that its ends 42, 42' coincide with the folding lines 43 between the flaps 6 and turned-down pieces 8.

The reinforcements corresponding to the tops 29, 29' of the inverted "V" and the lateral edges 33, 33' are glued on the inner face of the cutout, and have longitudinal peripheries 44 which are situated entirely spaced from the lines 7 of folding or junction with the adjacent lateral walls on the tab.

Entirely spaced means that they do not coincide, and/or are not situated beyond the line of junction with overlapping of the surface of the reinforcement with said line of junction.

The distance d is thus for example several centimeters, for example 20 cm on each side, depending on the dimensions of the box.

Figure 8:
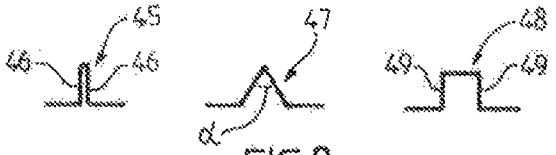
FIG. 8 shows schematic views in cross-section of three embodiments of reinforcements which can be used according to the invention, in the form of a "U" (with branches which are close together and spaced), and in the form of a "V".

FIG. 8 represents three embodiments of the transverse cross-sections of reinforcements according to the invention.

45 represents a reinforcement in the form of an inverted "U", wherein the branches 46 of the "U" are very close, for example 1 cm apart from one another, with the lateral edges for their part being horizontal.

At 47, the reinforcement has a cross-section in the form of an inverted "V", the angle $\alpha$ at the top being able to vary for example between 15° and 60°, and to be for example 45°.

At 48, the cross-section is an inverted "U" with walls 49 which are more spaced, i.e. by more than 1 cm, for example 3 or 5 cm.

Figure 9:
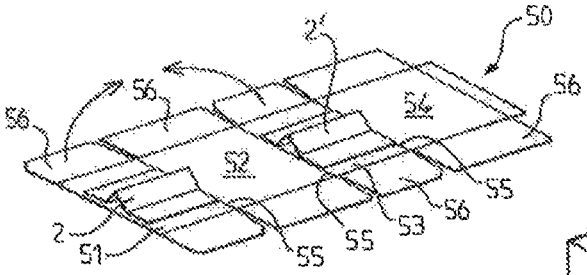
Figure 10:
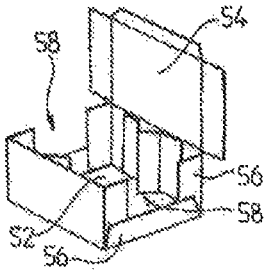

FIGS. 9 and 10 show another embodiment of packaging according to the invention.

Starting with the film 50 in FIG. 9 comprising a series of four flaps 51, 52, 53, 53 which are connected to one another by folding lines 55, each flap being provided with turned-down pieces 56 on both sides, the reinforcements 2, 2' are placed transversely, i.e. in a direction perpendicular to the folding FIG. 55 on the width of two opposite flaps.

The packaging 57 in FIG. 10 is then obtained by folding, with the two flaps without a reinforcement acting respectively as a base and a lid, and the two other lateral walls (without turned-down pieces) being formed by gluing of corresponding turned-down pieces 56, thus for example providing two perforated walls 58 as a result of the appropriate dimensioning of said turned-down pieces. The reinforcement films 3, 31 for their part are supplied from lateral vertical stores 76 situated on both sides of the path of the cutouts.

They are grasped by gripping systems 77 similar to the systems 12 described with reference to the preceding figures, said systems 12 being themselves displaced to their different positions by displacement devices which permit the unstacking and compression (not represented), for example as previously described.

The systems 77 are placed on the templates 78 in order to form the reinforcements, then the latter are displaced in portions for fitting onto a cutout (arrow 79).

Gripping systems 80 similar to the systems 77 are then lowered onto the templates 78 then raised (arrow 81—cf. FIG. 15) and displaced (FIG. 16) in order to be lowered (FIG. 17) onto the cutout 71 (arrow 82) and compressed, after being glued whilst along the path.

Then (FIG. 18) the systems 80 are raised and the cutout 4 provided with reinforcements 2, 2' is discharged, with the cycle continuing with the following cutout.

Figure 11:
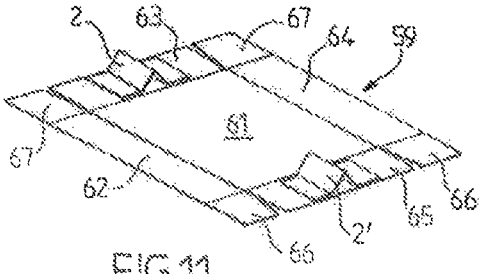
Figure 12:
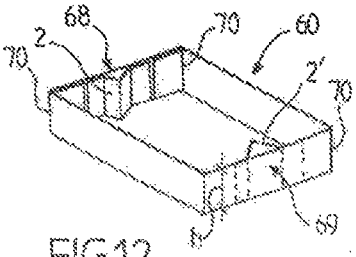
Figure 13:
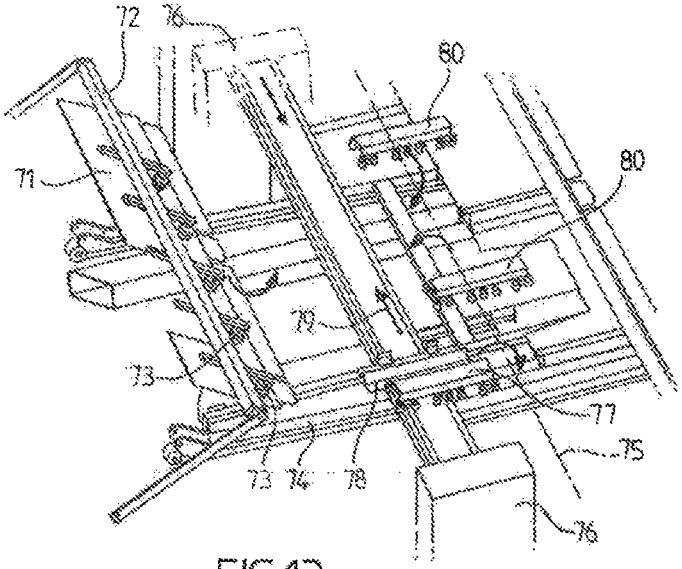
Figure 14:
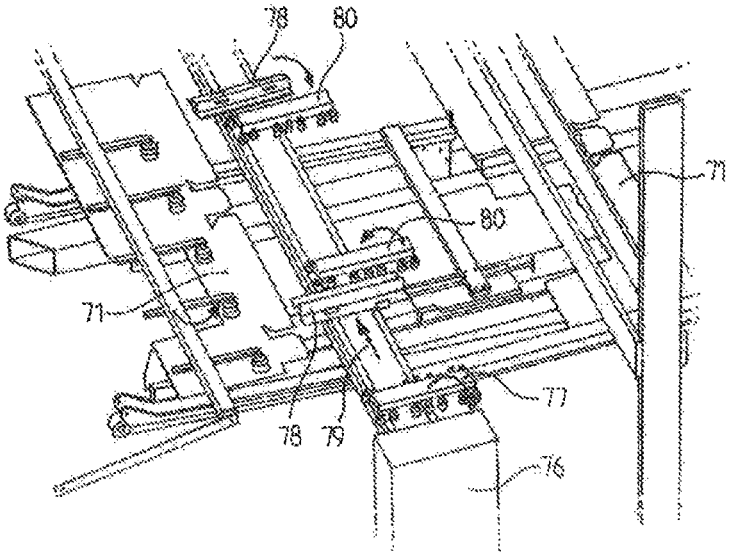
Figure 15:
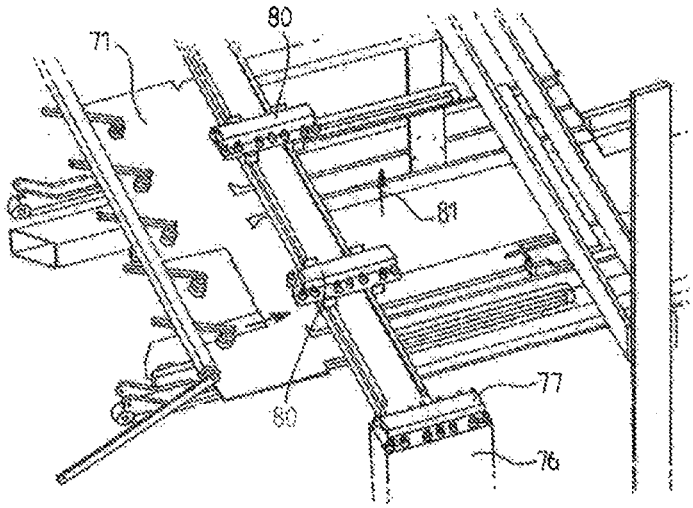
Figure 16:
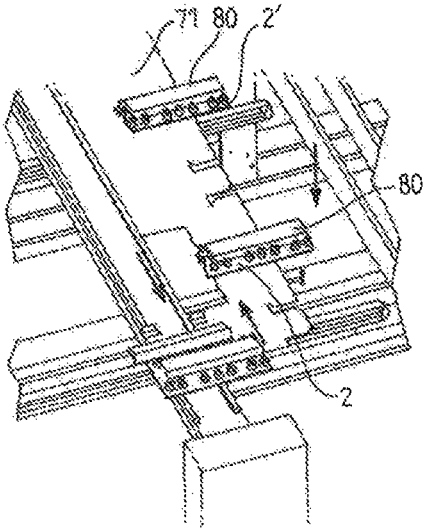
Figure 17:
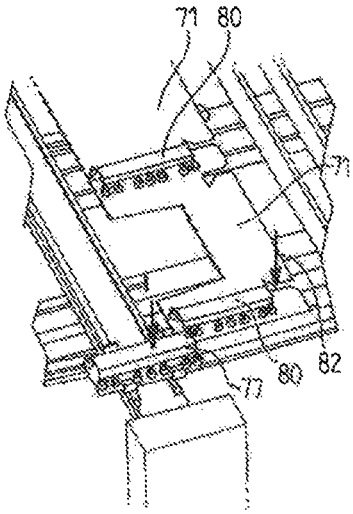
Figure 18:
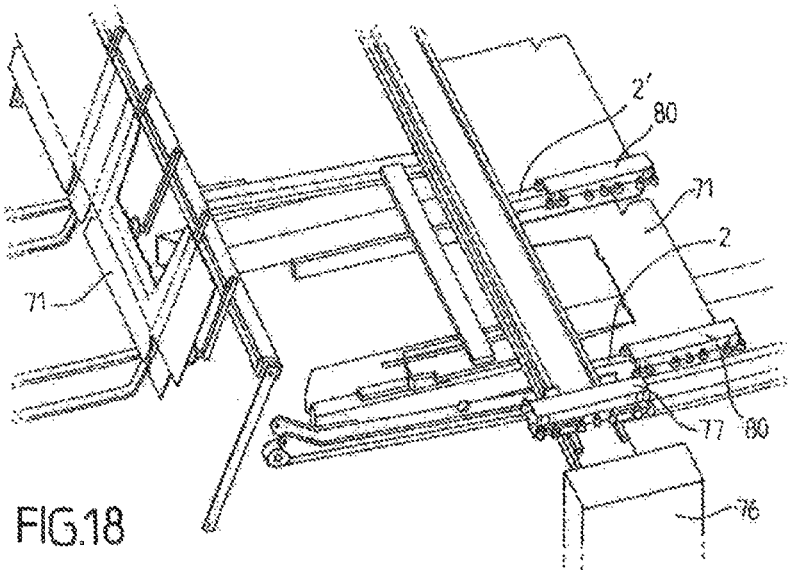

FIGS. 11 and 12 show respectively a film 59 and the tray 60 obtained from the film.

In this case, the film is formed by a central flap 61 provided with four turned-down pieces 62, 63, 64, 65 on its lateral edges, two turned-down pieces 62, 64 being provided with end turned-down pieces 66, 67, and the two other turned-down pieces comprising the reinforcements 2, 2' as previously described. When the tray is formed (cf. FIG. 12) it then comprises two walls 68, 69 provided with reinforcements 2, 2' along their height h, according to the invention, entirely situated spaced from the ends 70 of turned-down pieces which form corresponding walls.

A structure implementing the putting into phase of the reinforcement according to the invention is represented (partially) with reference to FIGS. 13 to 18.

In this case, a central store for supply of cutouts 71 is provided. The latter are tilted by a system 72 with suckers 73 which in itself is known, in order to be arranged flat on a horizontal conveyor 74 which then conveys them to the depositing location (broken line 75).

FIG. 19 represents an enlarged view of the assembly of the gripping means or system 12, 77 with a template 18, 78 (also designated as a gripping and forming unit) as described with reference to the preceding figures.

The system 12 comprises a longitudinal structure 13 with a lower face 14 provided with a central groove 15 which is in the form of an inverted "V" or "U", the branches of the "U" in this case being inclined relative to the vertical, or is also in the form of an Ω.

The lower face 14 also comprises the parallel horizontal longitudinal branches 16 which extend the periphery of the groove towards the exterior over a given distance d, for example of a few millimeters, which will make it possible to break the blank at its folding lines which are provided for this purpose.

The longitudinal structure 13 is integral with the gripping suckers 20, for example two lateral sets 83 of them, situated on both sides of the structure 13, consisting of seven suckers arranged in groups of two or three suckers. The template 18 for its part comprises a central rib with a form complementary to the form of the groove 15, and two lateral longitudinal edges 85 which extend the lower peripheral line 86 of the groove.

The length l of the groove is advantageously equal to, or slightly longer (by a few millimeters) than the length (or height) of the reinforcement to be configured.

FIGS. 20 to 23 show another embodiment of a partial device 90 according to the invention, with tilting of the reinforcements 2, 2' and gluing in the interior 91 of preformed packaging 92.

The films 3, 3' are grasped (FIG. 20) by gripping systems 12 as previously described, from two stores 93 which are arranged in parallel, whilst the templates 18 for formation of the reinforcements 2, 2' are put into position (FIG. 21) secured on trays 94 which pivot around an axis 95, between a horizontal position for receipt of the blanks (FIG. 22) and a vertical position for fitting of the reinforcements 2, 2' on opposite facing inner walls of the packaging 92.

In this embodiment, two, non-vertical systems 96 identical to the systems 12 are designed to collect the formed and tilted blanks 3, 3', then displace them plumb with the packaging brought successively, for example on a conveyor belt 97, before being blocked in position between two lateral doors which pivot around a vertical axis 98.

The reinforcements (cf. FIG. 21) are lowered and pass in front of guns 99 for gluing (hot melt) the outer faces of the strips, and are then inserted in the packaging before being pressed and glued on the inner face opposite, by pressure by means of jacks 100.

Figure 22:
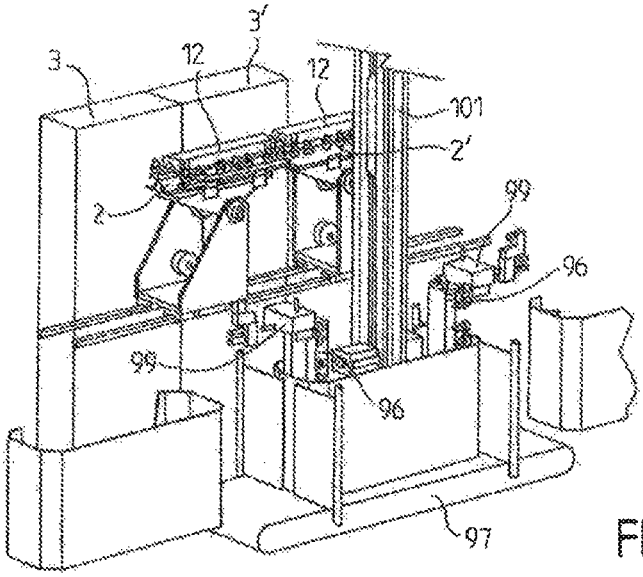
Figure 23:
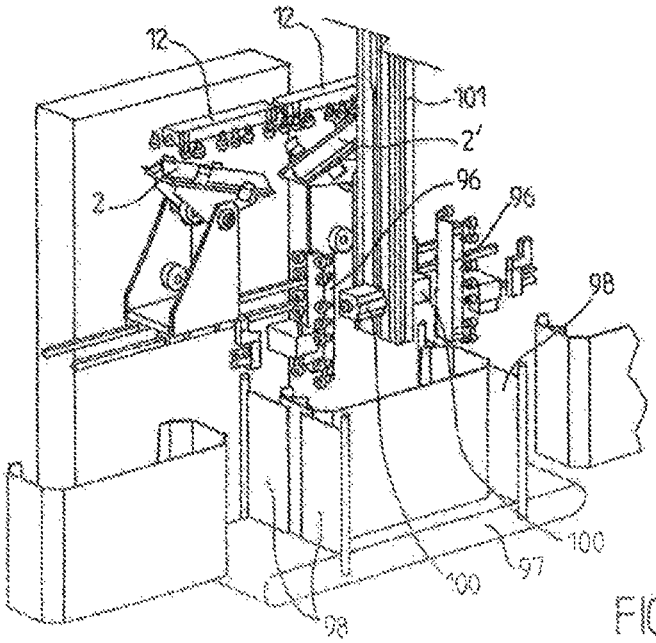

The latter are lowered simultaneously with the system 96, vertically, via a retractable vertical support ramp 101 which is displaceable between a position for loading of the reinforcements (FIG. 21) and a position for gluing of the reinforcements (FIG. 22). As will be appreciated, and as is also apparent from the foregoing description, the present invention is not limited to the embodiments more particularly described. On the contrary, it incorporates all the variants, and in particular those in which the form of the grooves is different.

The invention claimed is:

1. A method for fitting at least one reinforcement at a given location of a cardboard or corrugated cardboard sheet cutout, which can form packaging provided with walls having a given height, said given location being located on one of said walls, the at least one reinforcement being obtained from a cardboard or corrugated cardboard blank, the said at least one reinforcement having a height equal to said given height of the said walls, comprising:

extracting the blank from a store by grasping it by aspiration using unstacking means comprising a longitudinal structure with a given form, designed to be placed above the blank thus grasped in the direction of the length of the blank;

transferring the blank horizontally above a template for forming of said blank with a form which is at least partly complementary to said given form;

compressing the blank between the template and said longitudinal structure, in order to provide part of the blank with said given form, and form horizontal longitudinal lateral edges;

transferring the blank thus configured whilst gluing the lateral edges; and applying the blank thus glued on the cutout in the given location, in order to form the reinforcement of said packaging, said reinforcement being arranged in the direction of the height of the box.

2. The method as claimed in claim 1, wherein the given form has a transverse cross-section in the form of an inverted "V" or "U".

3. The method as claimed in claim 1, wherein two reinforcements are formed and fitted simultaneously on two opposite walls of the cutout which can form the packaging.

4. The method as claimed in claim 3, wherein the reinforcement blanks are transferred from two different stores situated in the vicinity of one another.

5. The method as claimed in claim 3, wherein the reinforcement blanks are transferred from two different stores situated on both sides of the cutout.

6. The method as claimed in claim 3, wherein the reinforcement blanks are obtained from a single store of blanks with a divisible base, which bases are separated into two before transfer above their respective template.

7. The method as claimed in claim 1, wherein with the cutout being formed by a series of at least four flaps ending on one side in a series of turned-down pieces, said cutout is placed flat, and said reinforcements are applied horizontally on said cutout.

8. The method as claimed in claim 1, wherein with the cutout preformed as a box which is open at the top, and having at least four vertical walls, the reinforcements are tilted vertically, then introduced into the packaging before being applied laterally on two opposite vertical walls of the packaging.

9. A device for fitting at least one reinforcement in a given location of a cardboard or corrugated cardboard sheet cutout which can form packaging provided with walls having a given height, said given location being located on one of said walls, the reinforcement being obtained from a cardboard or corrugated cardboard blank, the said at least one reinforcement having a height equal to said given height of the said walls, comprising:

means for gripping the blank in a store by aspiration, comprising unstacking means comprising a longitudinal structure with a given form, designed to be placed above the blank thus grasped;

a template for forming said blank with a form which is at least partly complementary to said given form;

means for transfer of the blank horizontally above said forming template, compression of the blank between the template and said longitudinal structure in order to provide it partly with said given form, and to have horizontal longitudinal lateral edges, and transfer of the blank thus configured opposite the cutout in the given location; and means for gluing the lateral edges and pressing the blank thus glued on the cutout in order to form the reinforcement of said packaging, said reinforcement being arranged in the direction of the height of the box.

10. The device as claimed in claim 9, wherein the given form has a transverse cross-section in the form of an inverted "V" or "U".

11. The device as claimed in claim 9, comprising two gripping means, two forming templates, two transfer and gluing means, and two means for pressing two blanks in order to form two reinforcements on two opposite walls of the packaging.

12. The device as claimed in claim 11, comprising two stores for supplying two different blanks situated in the vicinity of one another.

13. The device as claimed in claim 11, comprising two different supply stores situated on both sides of the cutout.

14. The device as claimed in claim 13, comprising a single store with divisible base blanks, and means for separation of the base blank into two blanks, before transfer of said two blanks above their respective template.

15. The device as claimed in claim 9, wherein with the cutout being formed by a series of at least four flaps which end on one side in a series of turned-down pieces, the device comprises means for bringing the cutout flat, and for application of said reinforcements horizontally on said cutout.

16. The device as claimed in claim 9, wherein with the cutout preformed as a box open at the top, and having at least four vertical walls, the device comprises means for vertical tilting of the reinforcements, introduction into the packaging, and application laterally on two opposite vertical walls of the packaging.

* * * * *